United States Patent [19]

Pieschke

[11] 4,203,356

[45] May 20, 1980

[54] BAFFLE FOR GAS HEATER VENTS

[76] Inventor: Lawrence J. Pieschke, Box 171, Woodslee, Ontario, Canada, N0R 1V0

[21] Appl. No.: 965,080

[22] Filed: Nov. 30, 1978

[51] Int. Cl.[2] ..... F23L 17/02

[52] U.S. Cl. ..... 98/66 R; 98/119; 126/85 B; 126/307 A

[58] Field of Search ..... 126/80, 9 R, 83, 85 B, 126/307 R, 307 A; 98/58, 60, 61, 66, 78, 79, 83, 115 R, 119, 122

[56] References Cited

U.S. PATENT DOCUMENTS

| | | | |
|---|---|---|---|
| 478,820 | 7/1892 | Schneider | 126/9 R |
| 920,763 | 5/1909 | Lauritzen | 98/83 |
| 2,300,088 | 10/1942 | Artis | 98/58 X |
| 2,486,780 | 11/1949 | Fenderg | 126/307 A |
| 2,647,477 | 8/1953 | Martin | 126/85 B |
| 3,726,267 | 4/1973 | Cavestany et al. | 126/307 R |

FOREIGN PATENT DOCUMENTS

| | | | |
|---|---|---|---|
| 278630 | 10/1927 | United Kingdom | 126/307 A |
| 1332661 | 10/1973 | United Kingdom | 126/307 A |

*Primary Examiner*—Henry C. Yuen
*Assistant Examiner*—Harold Joyce
*Attorney, Agent, or Firm*—Charles Krassov

[57] ABSTRACT

This invention is an enclosure for the part of a gas heater vent which protrudes on the outside of a wall of the building in which the gas heater is installed. It consists of a sheet metal rectangular baffle which encloses the front, sides, and part of the top of the vent part, and is attached to the wall of the building. A variation of the invention provides for the easy removal and reattachment of the baffle; and another variation fully encloses the top and bottom of the baffle; provides a chimney for the discharge of gases at the top of the baffle, and a rain and snow shield for the top of the chimney.

1 Claim, 3 Drawing Figures

BAFFLE FOR GAS HEATER VENTS

This invention consists of a baffle which is installed on the outside of a building wall to cover the vent of a heater which is located within the building.

Heaters for heating residential or commercial premises can be generally divided into two types, i.e. the small heating unit which is commonly used in the heating of one room or a small number of rooms, and the large furnaces used in the central heating systems of large buildings. In so far as this invention is concerned we are referring to the small type of gas heater which is commonly used in small homes, and which is usually located against the wall in one of the rooms. The combustion gases are usually vented through a suitable opening in the wall of the building which is covered on the outside with a grille or a specially designed vent which comes as part of the heater.

This type of vent installation creates a number of problems, some of which are, (a) Difficulties in igniting and maintaining the ignition of the heater due to the wind backing up through the vent, into the heater.

(b) Snow and Ice accumulates in the vent then it melts and it wets the interior of the heater.

(c) Dust and other solid matter accumulates in the vent and heater and requires a cleaning operation.

(d) A great deal of valuable heat is lost through the vent.

It is therefore the object of this invention to eliminate as much as possible these problems; and this is accomplished by providing a suitable baffle which partly or entirely encloses the vent.

Figure 1:
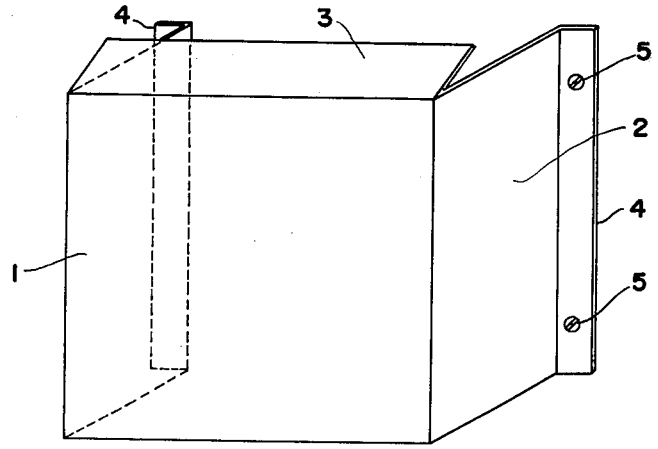
Figure 2:
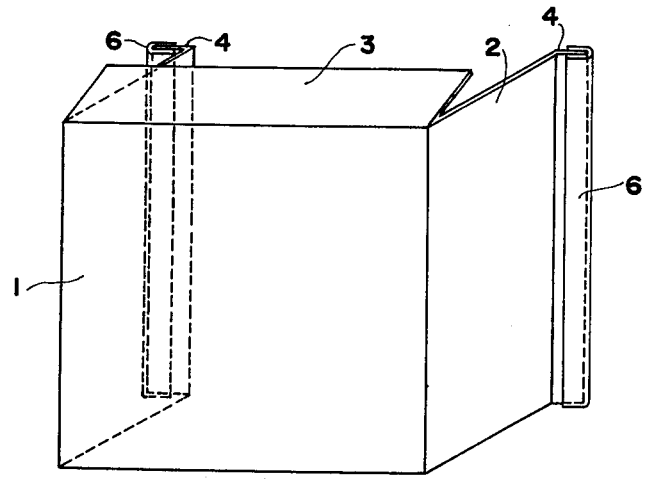
Figure 3:
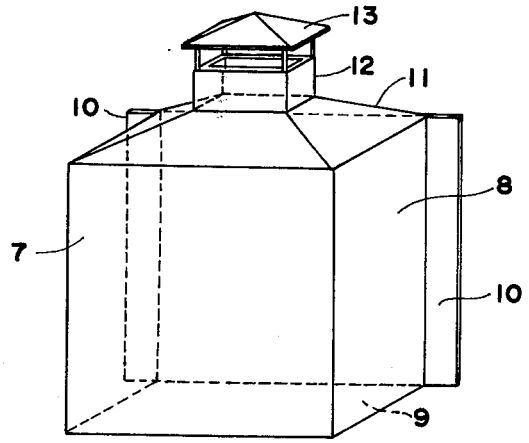

In describing the invention reference will be made to the attached drawings in which, FIG. 1 is an isometric view of the invention, FIG. 2 is an isometric view of a variation of the invention, and FIG. 3 is an isometric view of another variation in the construction of the invention.

In FIG. 1 of the drawings, the invention, which is preferably made of sheet metal, is shown consisting of a baffle which fits over and partly encloses the outside part of the heater vent. It consists primarily of an enclosure having a front rectangular wall 1 which has a rectangular side wall 2 extending from each vertical side thereof, and at right angles to the front wall. A narrow rectangular strip 3 extends at an upwardly bent angle from the top horizontal side of the wall 1. Each of the side walls 2 is bent outwardly, at right angles to the wall 2, into a narrow strip 4, at its free vertical side. The strips 4, which are equipped with spaced screw holes 5, are the means by which the said baffle is attached to the wall of the building, for the purpose of enclosing the vent.

In FIG. 2 is shown a variation in the construction of the baffle. The purpose of this variation is to make the baffle easily removable when so required. This is accomplished by providing a pair of channels 6,6, whcih are permanently attached to the wall of the building, and into which the strips 4 of the baffle can be inserted and held.

In FIG. 3 is shown a baffle which is similar to the ones shown in FIGS. 1 and 2, but which provides a greater amount of enclosure to the vent. This baffle is enclosed on all sides, except the rear, by a front rectangular wall 7, two rectangular walls 8,8, a cupola-shaped top 11, a short chimney 12, a rain cover 13 for the chimney, and two side strips 10,10, which correspond with the strips 4.

The baffles can be painted, or in any other way decorated to match the outside of the building to which the baffle is attached.

Having described my invention, what I claim is:

1. A baffle for enclosing the part of the vent of a gas heater which is located on the outside of a wall of a building containing the gas heater, said baffle comprising a sheet metal enclosure having a front rectangular wall, a side rectangular wall extending from each vertical edge of said front wall and bent at right angles thereto, an upper trapezoidal cover extending from the top edge of said front wall toward the building, second and third upper trapezoidal covers extending from the top edges of said side wall toward the other side wall, and a fourth upper cover extending from the rear wall of the building toward said front rectangular wall, the upper edges of said four upper covers terminating in a short chimney of rectangular horizontal cross section, a cover of generally pyramidal shape spaced above said chimney and extending beyond the four sides thereof, and means spacing said cover above said chimney to enable the escape of combustion gases but to prevent rain and snow from entering the chimney.

* * * * *